US009931260B2

(12) United States Patent
Mlungwana

(10) Patent No.: US 9,931,260 B2
(45) Date of Patent: Apr. 3, 2018

(54) PHYSICAL TRANSFER ELECTRIC ASSIST DEVICE/BOARD FOR PEOPLE IN THERAPY OR IN NEED OF SPECIAL CARE

(71) Applicant: Dumisani Mlungwana, Yorktown, IN (US)

(72) Inventor: Dumisani Mlungwana, Yorktown, IN (US)

( * ) Notice: Subject to any disclaimer, the term of this patent is extended or adjusted under 35 U.S.C. 154(b) by 0 days.

(21) Appl. No.: 15/687,305

(22) Filed: Aug. 25, 2017

(65) Prior Publication Data

US 2018/0055704 A1 Mar. 1, 2018

Related U.S. Application Data

(60) Provisional application No. 62/379,333, filed on Aug. 25, 2016.

(51) Int. Cl.
*A61G 7/10* (2006.01)

(52) U.S. Cl.
CPC ..... *A61G 7/103* (2013.01); *A61G 7/1034* (2013.01); *A61G 7/1074* (2013.01); *A61G 7/1076* (2013.01); *A61G 7/1088* (2013.01)

(58) Field of Classification Search
CPC ..... A61G 7/10
USPC ..... 5/81.1 R, 81.1 RP; 297/16.1, 344.21; 4/560.1, 578.1
See application file for complete search history.

(56) References Cited

U.S. PATENT DOCUMENTS 6,253,806 B1 * 7/2001 Sperry ..... B60P 7/065 141/10
2010/0038934 A1 * 2/2010 Bennett ..... A47K 3/122 297/16.1

* cited by examiner

*Primary Examiner* — Fredrick C Conley
(74) *Attorney, Agent, or Firm* — Ritchison Law Offices, PC; John D Ritchison

(57) ABSTRACT

A physical transfer device/board for people in therapy or in need of special care. It starts with a long plank that bridges between the start and finish point and then the plank has a movable, rotating disk with an optional back and leg rest. The disk slides from Point A start to Point B finish and is actuated by an electric motor powered with a battery or electricity from a plug-in receptacle. The whole device is portable with a foldable leg structure to securely and safely support the patient. The use and method of the device anticipates transfers such as a patient in a bed or wheel chair transfer to a tub, shower, toilet or other place for some personal or medical need.

12 Claims, 10 Drawing Sheets

ELECTRIC TRANSFER ASSIST DEVICE FRONT VIEW

ROTATING SLIDING DISK

ELECTRIC TRANSFER
ASSIST DEVICE FRONT VIEW

TOP STRUCTURE

TOP PLANK STRUCTURE

40Φ ≈12 in
31
45
46
51
50
33
40Φ ≈12 in
66
65
32
68
40A
33
47
42
42
40
50A
40B
40
51
31
67
47
33A
70

ALL FIGURES
ROTATING SLIDING DISK
40B
49
42W≈1-1/2in
40A
70
50A
71
66
67
68
65
41
51
48
40
50
44
47
32
47
31

NO WHEEL END

TURNING LOCKING / UNLOCKING WHEEL END

40Φ ≈12 in
40
45
46
41
40B
42

SEAT DISK
42≈1-1/2in
40A
44

71
72
73
74
70

SEAT CONTROLLER 30A
77

30B
90

REMOVABLE / ADJUSTABLE FOOT SUPPORT

REMOVABLE / ADJUSTABLE BACK SUPPORT

PHYSICAL TRANSFER ELECTRIC ASSIST DEVICE/BOARD FOR PEOPLE IN THERAPY OR IN NEED OF SPECIAL CARE

CROSS-REFERENCE TO RELATED APPLICATIONS

This application claims the benefit of United States Provisional Patent Application with Ser. No. 62/379,333 filed Aug. 25, 2016, by Dumisani Mlungwana and entitled "Physical transfer device/board for people in therapy or in need of special care".

FIELD OF INVENTION

This invention relates to a Physical transfer device/board for people in therapy or in need of special care. Also it relates to medical devices, and more particularly to a device for transferring a patient in a bed or wheel chair to a tub, shower, toilet or other place the patient need to be transferred to for some personal or medical need. This invention relates to a device for transferring a patient from one location to another. More specifically, the invention relates to a portable sliding and rotating device for transferring a patient between two proximate locations such as a bed and a wheelchair. Further, this invention relates to the field of transferring patients from one surface to another, and more particularly to a system for aiding in the transfer of a patient from one support surface to another such as from a wheelchair to a hospital bed and vice versa. The present invention relates to the general art of supports, and to the particular field of devices used to move patients. The present invention relates generally to devices for transporting medical patients. More specifically, the invention relates to devices for transforming patients into and out of a bed.

FEDERALLY SPONSORED RESEARCH

None.

SEQUENCE LISTING OR PROGRAM

None.

BACKGROUND

Field of Invention and Prior Art

As far as known, there are no Physical transfer device/board for people in therapy or in need of special care or the like. It is believed that this product is unique in its design and technologies.

Background

Patients confined to a bed may experience difficulty in moving in and out of the bed. In a hospital environment, many times only one nurse or aide is available to assist the patient in and out of bed. As is usually the case, in medical surgical situations, rehabilitation, or long term care situations, the patients can offer little or no help to move themselves. The patient's hips may be the total weight bearing joints to support the patient in moving from a supine to an upright sitting position at the edge of the bed. In the course of moving the patient, the patient basically is "dead" weight. The aide must bend over the bed to grasp the patient and lift, pull, and turn the patient from a mechanically unsound position. This movement may injure the patient as well as the aide.

Those with lower extremity disabilities often have difficulty moving from one location to another. Often times these people are confined to a wheelchair and require assistance to transfer between a bed, tub, or toilet/commode to a wheelchair or similar device. Presently, assistance in transferring patients can be provided by transfer boards, which are generally solid, smooth, rectangular-shaped, plywood boards. To move a patient from a bed to a wheelchair, for example, one end of the transfer board is placed under the patient sitting on the edge of the bed, and the other end of the board is placed on the wheelchair seat. Generally with the assistance of at least one person or more, the patient slides across the board from the bed toward the wheelchair. The patient then sits on the corner of the wheelchair seat, and makes a half turn, backwards into the wheelchair, as the transfer board is removed. This operation usually requires considerable strength and effort by the patient as well as an assisting health care professional. If the patient lacks the required strength, as in the case of a disabled person or some senior citizens, more than one health care professional person may be needed to help slide the patient across the transfer board.

Patients are often transferred from one surface to another surface in medical facilities such as hospitals, clinics and surgery centers. For an operation, the patient is transported on a gurney, requiring a transfer from the hospital bed to the gurney and from the gurney to an operating table and vice versa when the operation is complete. Moving the patient from one surface to another is a difficult task because of the weight and bulk of the patient and the height of the surfaces which don't permit the medical staff to bend their knees to lift the patient, thereby creating severe stress on their backs and other joints and muscles, often leading to serious injuries of the medical staff. This problem is amplified when such patients as bariatric patients are involved, where the patient may weigh 400 to 800 pounds or more. Presently, a patient may be transferred by a practice of placing a heavy-duty sheet under the patient by "log-rolling" the patient to his or her side, placing the sheet underneath the patient, rolling the patient to his or her back and then several medical staff members lifting the patient via the sheet to move the patient from one surface to another. For bariatric patients, often six or more medical staff are often required and many times, injuries occur. Injuries to interns, nurses and other medical staff are very costly to hospitals, surgery centers and the like. In addition, older and/or infirm people frequently experience limited movement of their limbs, physical instability, and reduced strength. These factors result in such persons experiencing great difficulty in transferring themselves in and out of bed. This is particularly the case in hospitals, nursing homes, and care centers where beds are considerably higher due to castors and elevating devices fixed to them. Likewise, patients recovering from surgery or the like are also subject to difficulties in moving from and to a bed to and from a chair. Aiding a patient to be extracted from a chair to a bed or vice versa, and to aid the attendant in removing the patient from the chair or bed, and transferring them to a bed or chair usually involves lifting the patient from the chair or bed to a standing position, then having to turn, or, orient, or turn them, while in the stationary standing position, and aiding them in setting down on a bed or chair, or other convenience.

It has been customary to lift the patient to a desired position, turn them 180 degrees, and then maneuver them to a sitting position on the edge of the bed or chair, and then aid them in laying or sitting down, and further maneuvering them to a desired position. During this maneuver, especially in the act of turning the patient 180 degrees, while in the erect position, with the patient's weight on the floor, the patient's feet can easily become tangled, causing a problem in re-orienting the feet to conform to the turning motion of the body. In many cases, this is a very painful experience to the patient, and, in the case of a hip, or leg injury, serious damage to the injury can occur. In the case of patients with Alzheimer's disease, the patient becomes dis-oriented, and is unable to cooperate with the attendant, and a lengthy process ensues, with the attendant having the problem of holding the patient's weight during the turning of the feet. It is customary to have an additional attendant to accomplish this task.

Transfer of a physically impaired or disabled individual from one location to another can be a formidable task, especially when only one other person is available to assist in such transfer. This latter situation, of course, is often the case when the physically impaired individual is at home or in other non-institutional environments.

Problem Solved

A need has thus arisen for a device to assist in patient movement into and out of a bed whereby difficult movements and movements which may injure a patient are substantially eliminated. It therefore is an object of the present invention to greatly reduce the amount of assistance required in transferring a patient or invalid between proximate locations. It is further an object of the present invention to reduce the amount of turning the patient must endure in transferring between these locations. These and other objectives are accomplished by the sliding and rotating transfer device herein described.

Therefore, there is need for a device to orient a patient from facing one direction to facing another direction that is simple, easy to use, easy to store and easy to maneuver. In hospitals, there is a frequent need to transfer a patient from a hospital bed to different areas of the hospital such as surgery or x-ray examination rooms. Typically, nurses or other hospital personnel such as orderlies/nurse assistants physically move the patient from the hospital bed to a transfer device which is then rolled to the desired area of the hospital. When the transfer device/gurney carrying the patient arrives at the desired section of the hospital, the technician once again, physically moves the patient onto another hospital or examination bed. The act of physically moving the patients can be tedious as well as dangerous to both the patient and the technician; patients who are at times are injured due to the further force applied by the technician to move the patient. Similarly, a technician may strain him/herself while attempting to move or support a heavy patient.

An object of the present invention is to provide a device for moving a patient from one hospital bed to a second hospital bed without requiring hospital personnel and/or the patient to exert any force during the transfer. Further the object is to provide a novel arrangement of parts or attachments which can be added and attached to existing or new beds or designed into new beds which will significantly assist in the comfortable transfer of a person or patient from one bed to another bed or surface.

Prior Art

Prior art of devices in this field are as follows: (a) Patent Application US2010/0319121 called Maneuverable Patient Transfer Device by Polomsky; (b) U.S. Pat. No. 7,506,387 named Method And Apparatus For Patient Transfer and issued to Scordato et al. in 2009; (c) U.S. Pat. No. 5,937,456 known as Device For Transferring A Patient To And From A Hospital Bed and issued to Norris in 1999; (d) Design Pat. D395,852 called Patient Transfer Seat and issued to Ditommaso in 1998; (e) U.S. Pat. No. 5,381,569 named Patient Turning and Positioning Device And Method and issued to Church in 1995; (f) U.S. Pat. No. 5,282,284 named Sliding Transfer Device and issued to Brantman et al. in 1994; (g) U.S. Pat. No. 4,819,283 known as Invalid Transfer Arrangement by DiMatteo et al. in 1989; (h) U.S. Pat. No. 4,776,047 called Multiple Function Invalid Bed Arrangement and issued to DiMatteo et al. in 1988; (i) a U.S. Pat. No. 7,818,836 named Device For Positioning Bedridden Individuals provided to Stinson in 2010; (j) U.S. Pat. No. 6,728,979 called Patient Transfer Device by Robert and issued in 2004; (k) U.S. Pat. No. 6,378,148 known as Patient Transfer System and issued to Votel in 2002; (l) U.S. Pat. No. 5,651,149 called Apparatus For Moving Disabled Persons earned by Garman in 1997; (m) another U.S. Pat. No. 5,579,547 named Patient Lift-Transfer Mechanism For Gurney by Hunt in 1996; (n) U.S. Pat. No. 5,271,110 known as Patient Transfer Device by Newman in 1993; (o) a further U.S. Pat. No. 4,821,352 called Invalid Transfer Arrangement again by DiMatteo et al. in 1989; (p) yet another U.S. Pat. No. 4,510,633 named Invalid Transfer Means and issued to Thorne in 1985; and finally (q) U.S. Pat. No. 4,180,879 called a Body Positioner by Mann in 1980. None of these have the unique features of the current inventions nor anticipate this new device as a person skilled in the art of transfer devices would readily see.

SUMMARY OF THE INVENTION

This invention is a Physical transfer device/board for people in therapy or in need of special care. Taught here are the ways a transfer of a patient may be efficiently and comfortably accomplished. The function/purpose is to transfer a disabled person from/to from point A or start to point B or end (and vice versa). A high functioning individual (with strong upper body: upper extremities & torso strength) can be trained to use the device independently while an individual with (weak and/or lack upper body strength) will need to be assisted. The device will be used to transfer an individual between various surfaces such as bed to wheel-chair, wheel-chair to toilet seat/toilet commode, wheel-chair to shower chair/bench (and vice versa). The structure is generally a rectangular shaped Therapeutic/Rehabilitative Electrical device, four legged steel with locking/unlocking rolling casters, the top/base and rotating/sliding structure made of wood/fiber glass. The rotating disc can be locked in place once the individual is in a desired position. The device will consist of removable back & leg/foot supports and an electrical controller with a backing battery system.

The preferred embodiment of a Physical transfer device/board for people in therapy or in need of special care the device is made of durable and lightweight materials and comprised of: (a) a top structure comprised of a rotating and sliding disk, the disk with a tapered perimeter on its top surface and with a center post connecting to a support plate; (b) the support plate further comprised of a center means for connecting the center post to the rotating and sliding disk and further comprised of roller or wheel mechanism to support which provides a structural means for siding and rolling the support plate across a top plank/board as a gear mechanism is activated; (c) the top plank/board further comprised of an upper and lower surface and a disk path/groove; (d) a driving mechanism further comprised of a power source connected to a motor with a rotating shaft, a means for transferring rotation force from the rotating shaft to a linear drive mechanism in the disk path/groove, a connection means for transferring rotation force to the seat disk, and a fastening means for securing the driving mechanism to the bottom surface of the plank; and (e) a set of front legs and a set of rollable back legs, each set comprised of telescoping legs and supporting struts and each set with a securing means for hingeably/and removably connecting front legs or rear legs to lower surface of plank/board wherein the device can assist a patient moving from one flat surface, Point A, to a second flat surface, Point B.

The newly invented Physical transfer device/board for people in therapy or in need of special care may be manufactured at low volumes by very simple means and in high volume production by more complex and controlled systems.

ADVANTAGES

There are several objects and advantages of the Physical transfer device/board for people in therapy or in need of special care. There are currently no known Physical transfer device/board for people in therapy or in need of special care that are effective at providing the objects of this invention.

Physical transfer device/board for people in therapy or in need of special care has various advantages and benefits:

| Item | Advantages |
|---|---|
| 1 | facilitates and/or promotes independence with transfers. As stated, certain individuals can be trained to use the device independently. |
| 2 | minimizes the incidents of accidental injuries, such as injuries to patients or staff. Injuries that can be caused by improper lifting of patients or improper transfer techniques by staff. |
| 3 | is economically useful in terms of saving time and labor involved in transferring disabled individuals. Also money saved in minimizing injuries can be caused by improper transfers. |
| 4 | preserves a patient's dignity by allowing them to provide maximum level of participation in transfers. As well as by eliminating discomfort that can be caused by improper handling and/or touch of patients. |
| 5 | can be used as a marketing tool. An effective/efficient, economical device that enhances independence and brings dignity in the way disabled population is being cared for, will attract clientele into the facilities where it is being used. |

Finally, other advantages and additional features of the present Physical transfer device/board for people in therapy or in need of special care will be more apparent from the accompanying drawings and from the full description of the device. For one skilled in the art of patient care and transfer devices and systems, it is readily understood that the features shown in the examples with this product are readily adapted to other types of patient transfer systems and devices.

DESCRIPTION OF THE DRAWINGS

Figures

The accompanying drawings, which are incorporated in and constitute a part of this specification, illustrate an embodiment of the Physical transfer device/board for people in therapy or in need of special care that is preferred. The drawings together with the summary description given above and a detailed description given below serve to explain the principles of the Physical transfer device/board for people in therapy or in need of special care. It is understood, however, that the Physical transfer device/board for people in therapy or in need of special care is not limited to only the precise arrangements and instrumentalities shown.

DESCRIPTION OF THE DRAWINGS

Reference Numerals

Figure 1:
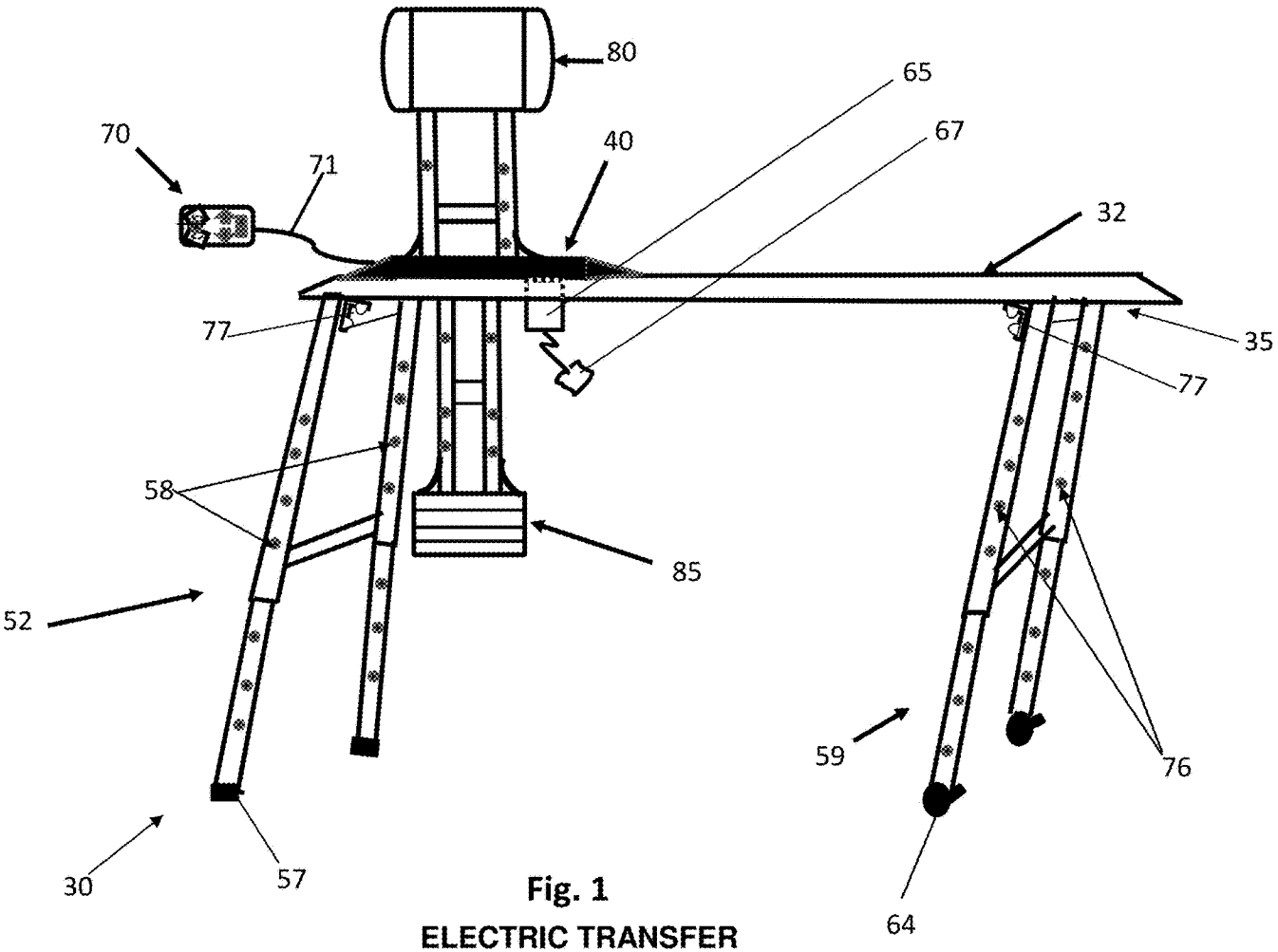
FIG. 1 is a sketch of the Physical transfer electric assist device/board for people in therapy or in need of special care.

The following list refers to the drawings:

TABLE B

| Reference numbers | |
|---|---|
| Ref. | Description |
| 30 | physical transfer electric assist device/board 30 for people in therapy or in need of special care |
| 30A | fully detailed physical transfer electric assist device/board 30A |
| 30B | folded 30B physical transfer electric assist device/board 30 |
| 31 | top structure 31 of the physical transfer electric assist device/board 30, 30A |
| 32 | top plank/board 32 having an upper and lower surface |
| 32L | top plank/board length 32L - approximately 36 inches |

TABLE B-continued

Reference numbers

| Ref. | Description |
|---|---|
| 32W | top plank/board width 32W - approximately 12 inches |
| 33 | disk path/groove 33 |
| 33A | alternative disk path/groove 33A |
| 34 | end taper on transfer board - width 34W approximately 1-1/2 inches |
| 35 | overlap 35 for transfer board - approximately 3 inches |
| 40 | rotating and sliding disk 40 |
| 40Φ | rotating and sliding disk diameter 40Φ - inch diameter) |
| 40A | side shield 40A for rotating and sliding disk 40 |
| 40B | top surface 40B of rotating and sliding disk 40 |
| 41 | center post 41 for rotating disk 40 |
| 42 | taper 42 (width 42W - approximately 1-1/2 inches) at perimeter of the for rotating disk 40 |
| 43 | means for connecting 43 the center post 41 to for rotating and sliding disk 40 |
| 44 | means for connecting 44 optional side shield 40A to rotating and sliding disk 40 |
| 45 | apertures 45 for mounting adjustable and removable back support 80 |
| 46 | apertures 46 for mounting adjustable and removable foot support 85 |
| 47 | drive mechanism 47 such as a worm gear mounted into the disk slots 33, 33A and engaging the disk gear 48 as a means to drive the back and forth travel of the disk gear fixture 48 and hence the support plate 50 and rotating/sliding disk 40 |
| 47A | motor gear/rotating connection 47A to transfer rotational force of motor 65 to drive mechanism 47 |
| 48 | disk gear fixture 48 connected to the support plate 50 |
| 49 | a fastening means 49 to secure and connect disk gear fixture 48 to the support plate 50 |
| 50 | support plate 50 of the rotating and sliding disk 40 |
| 50A | roller or wheel mechanism/system 50A to support, to provide a structural means for siding and rolling the support plate 50 across the plank 32 as the gear mechanisms 47, 48 are activated |
| 51 | center bearing/bushing 51 in support plate 50 of the rotating and sliding disk 40 or alternatively a means for connecting the motor to the rotating and sliding disk to transmit rotational force from the motor 65 to the disk 40 |
| 52 | front legs 52 no wheeled as a height adjustable end support |
| 52W | width 52W (approximately 12 inches) of adjustable front leg support 52 |
| 52H | height 52H (approximately 30 inches) of adjustable front leg support 52 |
| 53 | telescoping top tube structure 53 for front legs 52 |
| 53H | height 53H (approximately 18 inches) of telescoping top tube structure 53 for front legs 52 |
| 54 | telescoping lower tube structure 54 for front legs 52 |
| 54H | height 54H (approximately 12 inches) of telescoping lower tube structure 54 for front legs 52 |
| 55 | top strut support 55 for front legs 52 |
| 55A | top strut support 55A for front legs 52 supporting and attached by fasteners to the lower surface of the top plank 32 |
| 56 | bottom strut support 56 for front legs 52 |
| 57 | bottom end protectors 57 crutch tips or the like |
| 58 | apertures 58 in telescoping tubes 53 and 54 to receive quick fasteners 69 A-H |
| 59 | rear legs 59 with wheels as a height adjustable end support |
| 59W | width 59W (approximately 12 inches) of adjustable rear leg support 59 |
| 59H | height 59H (approximately 31-1/2 inches) of adjustable rear leg support 59 |
| 60 | telescoping top tube structure 60 for rear legs 59 |
| 61 | telescoping lower tube structure 61 for rear legs 59 |
| 62 | top strut support 62 for rear legs 59 |
| 62A | top strut support 62A for rear legs 59 supporting and attached by fasteners to the lower surface of the top plank 32 |
| 63 | bottom strut support 63 for rear legs 59 |

TABLE B-continued

Reference numbers

| Ref. | Description |
|---|---|
| 64 | bottom lockable wheels 64 or (approximately 1-1/2 to 3 inches) the like |
| 64A | height 64A (approximately 1-1/2 inches) above floor of bottom wheel pivot axis |
| 64B | support strut 64B for mounting wheels 64 to bottom strut 63 and telescoping lower tube structure 61 for rear legs 59 |
| 65 | electric, pneumatic, or hydraulic motor 65 or the like |
| 66 | connection 66/cord/hose to power source |
| 67 | power source 67 electric AC (electrical line current and power)/DC (battery or equal) or pneumatic or hydraulic |
| 68 | means 68 for removably connecting motor 65 to lower surface of plank/board 32 such as an angle and components or means to secure - fasteners, adhesives and the like |
| 69 A-F | quick connect/disconnect fasteners 69 A through F such as quick spring detents, cotter clip, spring clips and the like as shown in drawings FIGS. 7 A through 7 F for removably fastening telescoping legs 53, 54 for front legs 52 and 60, 61 for rear legs 59 through apertures 58, 76; similarly used with adjustable back support 80 and foot support 85 in apertures 84, 89 |
| 70 | controller 70 |
| 71 | cord or connection 71 from controller 70 to motor 65 and power source 67 |
| 72 | on/off switch 72 |
| 73 | back/forth switch 73 |
| 74 | optional rotate switch 74 |
| 76 | apertures 76 in telescoping tubes 60 and 61 to receive quick fasteners 69 A-H |
| 77 | means 77 for hingeably/pivotally/foldably and removably connecting front legs 52 or rear legs 59 to lower surface of plank/board 32 such as an plates and a hinge with components or means to secure - fasteners, adhesives and the like |
| 80 | adjustable and removable back support 80 |
| 80W | width 80W (approximately 18 inches) of adjustable and removable back support 80 |
| 80H | height 80H (approximately 12 inches) of adjustable and removable back support 80 |
| 80E | Extension 80E (approximately 21 inches) of adjustable and removable back support 80 from slidable disk 40 |
| 81 | back plate or plane 81 of the adjustable and removable back support 80 - durable material (plastic, metal, composite or the like) with or without padding |
| 82 | strut 82 to support and reinforce the tubular structure 83 of the adjustable and removable back support 80 |
| 83 | tubular structure 83 of the adjustable and removable back support 80 |
| 84 | mounting apertures 84 in the tubular structure 83 of the adjustable and removable back support 80 used to removably connect with the rotating disk 40 |
| 85 | adjustable and removable foot support 85 |
| 85W | width 85W (approximately 18 inches) of adjustable and removable foot support 85 |
| 85H | height 85H (approximately 6 inches) of adjustable and removable foot support 85 |
| 85E | Extension 85E (approximately 27 inches) of adjustable and removable foot support 85 from slidable disk 40 |
| 86 | foot plate or plane 87 of the adjustable and removable foot support 85 - durable material (plastic, metal, composite or the like) |
| 87 | strut 87 to support and reinforce the tubular structure 88 of the adjustable and removable foot support 85 |
| 88 | tubular structure 88 of the adjustable and removable foot support 85 |
| 89 | mounting apertures 89 in the tubular structure 88 of the adjustable and removable foot support 85 used to removably connect with the rotating disk 40 |
| 90 | carrying case 90 Physical transfer electric assist device/board 30/30A |
| 100 | patient 100 |

TABLE B-continued

| Reference numbers | |
|---|---|
| Ref. | Description |
| 105 | wheelchair 105 |
| 110 | hospital bed 110 |
| 112 | toilet or waste device 112 |
| 115 | tub/shower 115 |
| 120 | tub/shower stool 120 |
| 125 A-D | a patient 100 transferring 125 A-D to and from a hospital bed 110 to a wheel chair 105 |
| 130 A-C | a patient 100 transferring 130 A-C to and from a wheel chair 105 to a toilet or waste device 112 |
| 135 A-C | a patient 100 transferring 135 A-C to and from a wheel chair 105 to a tub or shower 115 seat/stool 120 |

DETAILED DESCRIPTION OF PREFERRED EMBODIMENT

The present development is the Physical transfer device/board for people in therapy or in need of special care. Particularly this invention relates to a Physical transfer device/board for people in therapy or in need of special care. Also it relates to medical devices, and more particularly to a device for transferring a patient in a bed or wheel chair to a tub, shower, toilet or other place the patient need to be transferred to for some personal or medical need. This invention relates to a device for transferring a patient from one location to another. More specifically, the invention relates to a portable sliding and rotating device for transferring a patient between two proximate locations such as a bed and a wheelchair. Further, this invention relates to the field of transferring patients from one surface to another, and more particularly to a system for aiding in the transfer of a patient from one support surface to another such as from a wheelchair to a hospital bed and vice versa. The present invention relates to the general art of supports, and to the particular field of devices used to move patients. The present invention relates generally to devices for transporting medical patients. More specifically, the invention relates to devices for transforming patients into and out of a bed.

The advantages for the physical transfer device/board for people in therapy or in need of special care vice 30 are above listed above in the application. Succinctly the benefits are that the device:

A. facilitates and/or promotes independence with transfers. As stated, certain individuals can be trained to use the device independently.

B. minimizes the incidents of accidental injuries, such as injuries to patients or staff. Injuries that can be caused by improper lifting of patients or improper transfer techniques by staff.

C. is economically useful in terms of saving time and labor involved in transferring disabled individuals. Also money saved in minimizing injuries can be caused by improper transfers.

D. preserves a patient's dignity by allowing them to provide maximum level of participation in transfers. As well as by eliminating discomfort that can be caused by improper handling and/or touch of patients.

E. can be used as a marketing tool. An effective/efficient, economical device that enhances independence and brings dignity in the way disabled population is being cared for, will attract clientele into the facilities where it is being used.

The preferred embodiment of a Physical transfer device/board for people in therapy or in need of special care the device is made of durable and lightweight materials and comprised of: (a) a top structure comprised of a rotating and sliding disk, the disk with a tapered perimeter on its top surface and with a center post connecting to a support plate; (b) the support plate further comprised of a center means for connecting the center post to the rotating and sliding disk and further comprised of roller or wheel mechanism to support which provides a structural means for siding and rolling the support plate across a top plank/board as a gear mechanism is activated; (c) the top plank/board further comprised of an upper and lower surface and a disk path/groove; (d) a driving mechanism further comprised of a power source connected to a motor with a rotating shaft, a means for transferring rotation force from the rotating shaft to a linear drive mechanism in the disk path/groove, a connection means for transferring rotation force to the seat disk, and a fastening means for securing the driving mechanism to the bottom surface of the plank; and (e) a set of front legs and a set of rollable back legs, each set comprised of telescoping legs and supporting struts and each set with a securing means for hingeably/and a securing means for removably connecting front legs or rear legs to lower surface of plank/board wherein the device can assist a patient moving from one flat surface, Point A, to a second flat surface, Point B.

There is shown in FIGS. 1-10 a complete description and operative embodiment of the physical transfer device/board for people in therapy or in need of special care. In the drawings and illustrations, one notes well that the FIGS. 1-10 demonstrate the general configuration and use of this product. The various example uses are in the operation and use section, below.

The accompanying drawings, which are incorporated in and constitute a part of this specification, illustrate an embodiment of the physical transfer device/board for people in therapy or in need of special care 30 that is preferred. The drawings together with the summary description given above and a detailed description given below serve to explain the principles of the physical transfer device/board for people in therapy or in need of special care 30. It is understood, however, that the physical transfer device/board for people in therapy or in need of special care 30 is not limited to only the precise arrangements and instrumentalities shown. Other examples of patient assist devices to move from one surface to another are still understood by one skilled in the art of patient assist devices to be within the scope and spirit shown here.

FIG. 1 is a sketch of the Physical transfer electric assist device/board 30 for people in therapy or in need of special care. Shown and demonstrated in this sketch are: the physical transfer electric assist device/board 30 for people in therapy or in need of special care; the top plank/board 32 having an upper and lower surface; the overlap 35 for transfer board—approximately 3 inches; the rotating and sliding disk 40; front legs 52 no wheeled as a height adjustable end support; bottom end protectors 57 crutch tips or the like; apertures 58 in telescoping tubes 53 and 54 to receive quick fasteners 69 A-H; rear legs 59 with wheels as a height adjustable end support; bottom lockable wheels 64 or (approximately 1½ to 3 inches) the like; electric or pneumatic motor 65 or hydraulic or the like; power source 67 electric AC (electrical line current and power)/DC (battery or equal) or pneumatic; controller 70; cord or connection 71 from controller 70 to motor 65 and power source 67; apertures 76 in telescoping tubes 60 and 61 to receive quick fasteners 69 A-H; means 77 for hingeably/pivotally/foldably and removably connecting front legs 52 or rear legs 59 to lower surface of plank/board 32 such as an plates and a hinge with components or means to secure—fasteners (bolts, pins, screws), adhesives, and the like; adjustable and removable back support 80; and an adjustable and removable foot support 85. The Physical transfer electric assist device is anticipated to be made from durable and lightweight materials such as aluminum, powder coated sheet metal, reinforced plastic, wood, pressed fiber board, composite materials and the like.

Figures 2A, 2B:
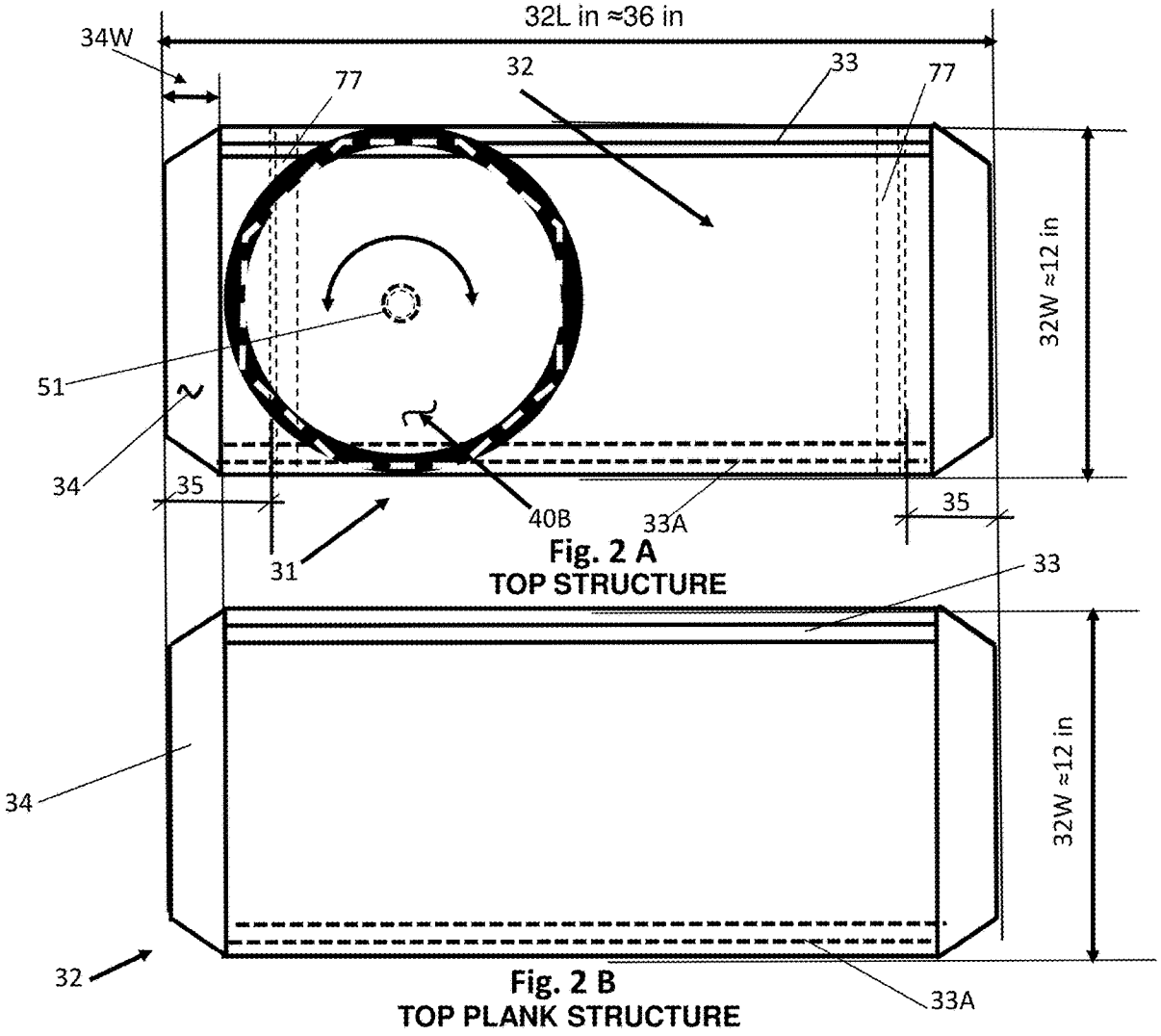
FIGS. 2A and 2B are sketches of the top structures and the top plank/board of the Physical transfer electric assist device/board for people in therapy or in need of special care.

FIGS. 2A and 2B are sketches of the top structures 31 and the top plank/board 32 of the physical transfer electric assist device/board 30 for people/patients 100 in therapy or in need of special care. In these sketches are shown: top structure 31 of the physical transfer electric assist device/board 30, 30A; top plank/board 32 having an upper and lower surface; top plank/board length 32L—approximately 36 inches; top plank/board width 32W—approximately 12 inches; disk path/groove 33; alternative disk path/groove 33A; end taper on transfer board—width 34W approximately 1½ inches; overlap 35 for transfer board—approximately 3 inches; and center bearing/bushing 51 (a bushing, ball bearing, needle bearings, thrust bearings and the like) in support plate 50 of the rotating and sliding disk 40 or alternatively a means for connecting the motor to the rotating and sliding disk to transmit rotational force from the motor 65 to the disk 40.

Figures 3A, 3B, 3C:
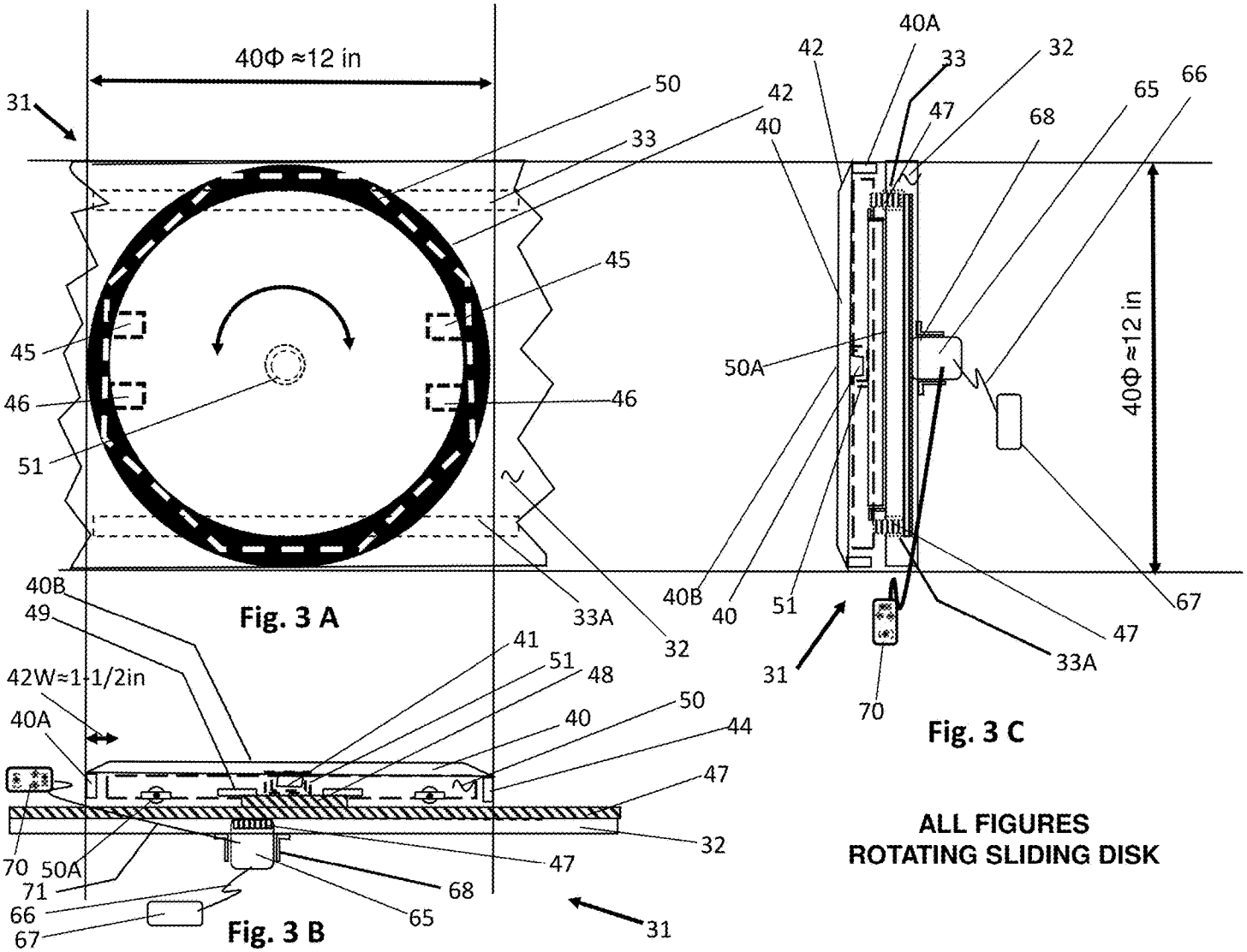
FIGS. 3A through 3C are additional sketches with the components and features shown from generally a top and side views of the Physical transfer electric assist device/board for people in therapy or in need of special care.

FIGS. 3A through 3C are additional sketches with the components and features shown from generally a top and side views of the physical transfer electric assist device/board 30 for people in therapy or in need of special care. These sketches show many components such as: top structure 31 of the physical transfer electric assist device/board 30, 30A; top plank/board 32 having an upper and lower surface; disk path/groove 33; alternative disk path/groove 33A; rotating and sliding disk 40; rotating and sliding disk diameter 40Φ—inch diameter); optional side shield 40A for rotating and sliding disk 40; top surface 40B of rotating and sliding disk 40; taper 42 (width 42W—approximately 1½ inches) at perimeter of the for rotating disk 40; means for connecting 44 optional side shield 40A to rotating and sliding disk 40; apertures 45 for mounting adjustable and removable back support 80; apertures 46 for mounting adjustable and removable foot support 85; drive mechanism 47 such as a worm gear mounted into the disk slots 33, 33A and engaging the disk gear 48 as a means to drive the back and forth travel of the disk gear fixture 48 and hence the support plate 50 and rotating/sliding disk 40; motor gear/rotating connection 47A to transfer rotational force of motor 65 to drive mechanism 47; disk gear fixture 48 connected to the support plate 50; means 49 to secure and connect disk gear fixture 48 to the support plate 50; support plate 50 of the rotating and sliding disk 40; roller or wheel mechanism/system 50A to support, to provide a structural means for siding and rolling the support plate 50 across the plank 32 as the gear mechanisms 47, 48 are activated; center bearing/bushing 51 (a bushing, ball bearing, needle bearings, thrust bearings and the like) in support plate 50 of the rotating and sliding disk 40 or alternatively a means for connecting the motor to the rotating and sliding disk to transmit rotational force from the motor 65 to the disk 40; electric or pneumatic or hydraulic motor 65 or the like; connection 66/cord/hose to power source; power source 67 electric AC (electrical line current and power)/DC (battery or equal) or pneumatic; means 68 for removably connecting motor 65 to lower surface of plank/board 32 such as an angle and components or means to secure—fasteners, adhesives and the like controller 70; and cord or connection 71 from controller 70 to motor 65 and power source 67.

Figures 4A, 4B:
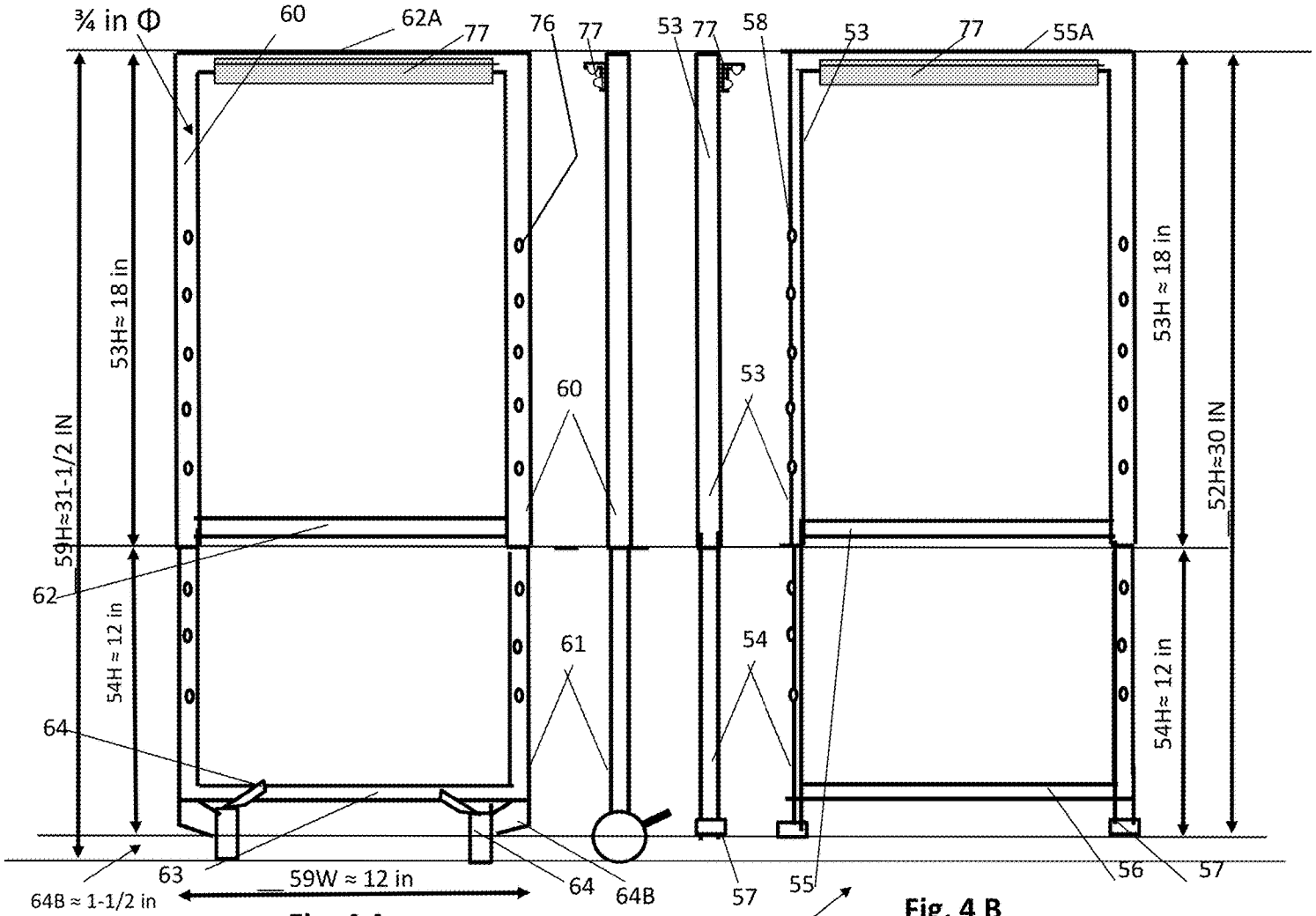
FIGS. 4A and 4B are sketches of the wheeled and non-wheeled ends with the components and features shown of the Physical transfer electric assist device/board for people in therapy or in need of special care.
Figures 5A, 5B, 5C, 5D, 5E, 5F:
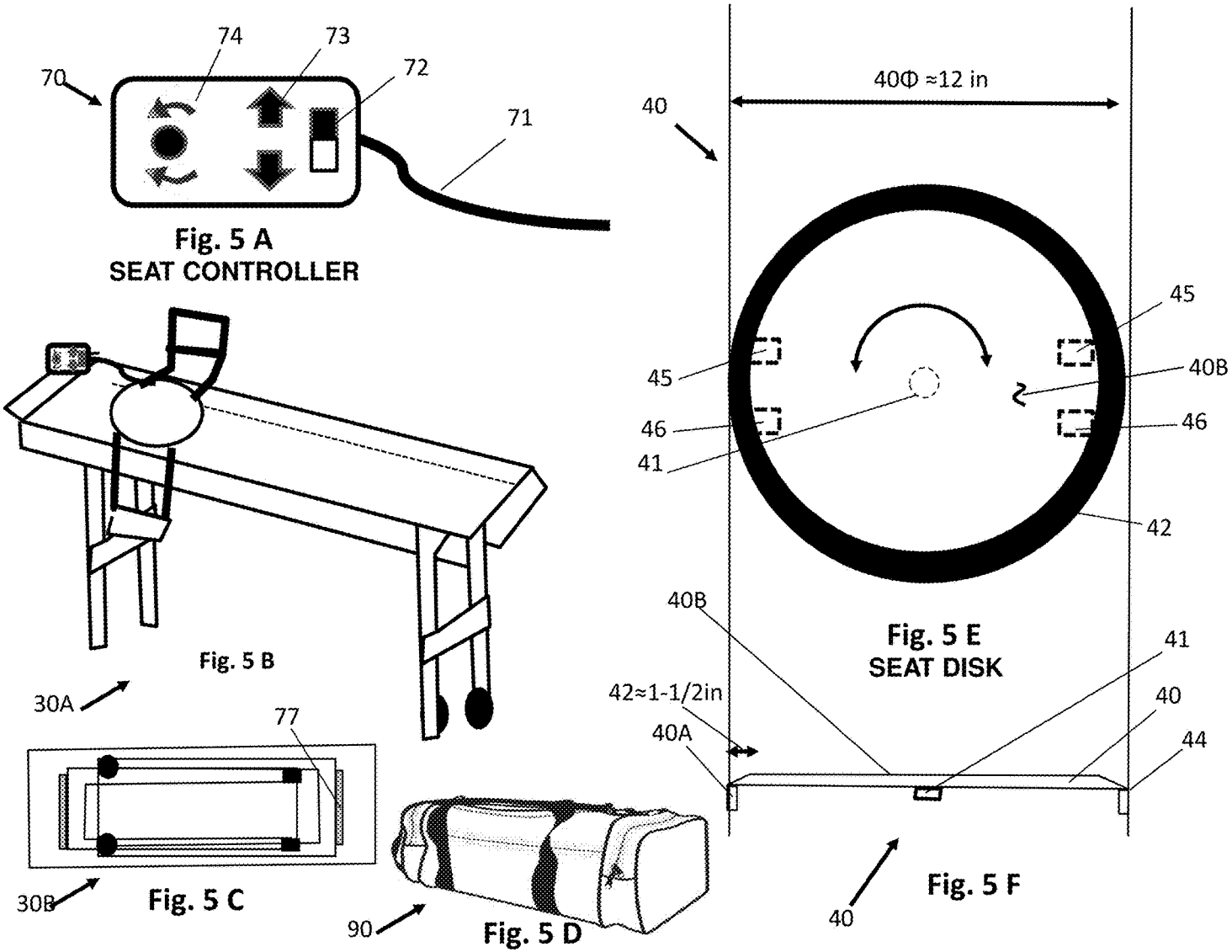
FIGS. 5A through 5F are sketches of the device controller, the built device, a folded device, a carrying case and the components and features of the seat disk all for the Physical transfer electric assist device/board for people in therapy or in need of special care.

FIGS. 4A and 4B are sketches of the rear wheeled 59 and front non-wheeled 52 end structures with the components and features shown of the physical transfer electric assist device/board 30 for people in therapy or in need of special care. Demonstrated in these sketches include: the front legs 52 no wheeled as a height adjustable end support; the width 52W (approximately 12 inches) of adjustable front leg support 52; the height 52H (approximately 30 inches) of adjustable front leg support 52; the telescoping top tube structure 53 for front legs 52; the height 53H (approximately 18 inches) of telescoping top tube structure 53 for front legs 52; the telescoping lower tube structure 54 for front legs 52; the height 54H (approximately 12 inches) of telescoping lower tube structure 54 for front legs 52; the top strut support 55 for front legs 52; the top strut support 55A for front legs 52 supporting and attached by fasteners to the lower surface of the top plank 32; the bottom strut support 56 for front legs 52; the bottom end protectors 57 crutch tips or the like; the apertures 58 in telescoping tubes 53 and 54 to receive quick fasteners 69 A-H; the rear legs 59 with wheels as a height adjustable end support; the width 59W (approximately 12 inches) of adjustable rear leg support 59; the height 59H (approximately 31-½ inches) of adjustable rear leg support 59; the telescoping top tube structure 60 for rear legs 59 telescoping lower tube structure 61 for rear legs 59; the top strut support 62 for rear legs 59; the top strut support 62A for rear legs 59 supporting and attached by fasteners to the lower surface of the top plank 32; the bottom strut support 63 for rear legs 59; the bottom lockable wheels 64 or (approximately 1½ to 3 inches) the like; the height 64A (approximately 1½ inches) above floor of bottom wheel pivot axis; the support strut 64B for mounting wheels 64 to bottom strut 63 and telescoping lower tube structure 61 for rear legs 59; and the apertures 76 in telescoping tubes 60 and 61 to receive quick fasteners 69 A-H means 77 for hingeably/pivotally/foldably and removably connecting front legs 52 or rear legs 59 to lower surface of plank/board 32 such as an plates and a hinge with components or means to secure—fasteners, adhesives and the like FIGS. 5A through 5B are sketches of the device controller 70, the built device 30A, a folded device 30B, a carrying case 90 and the components and features of the seat disk 40 all for the Physical transfer electric assist device/board 30 for people in therapy or in need of special care. For the controller 70 are shown: the controller 70; a cord or connection 71 from controller 70 to motor 65 and power source 67; an on/off switch 72; a back/forth switch 73; and an optional rotate switch 74. For the rotating and sliding disk 40 are demonstrated the rotating and sliding disk diameter 404)—inch diameter); optional side shield 40A for rotating and sliding disk 40; top surface 40B of rotating and sliding disk 40; center post 41 for rotating disk 40; taper 42 (width 42W—approximately 1½ inches) at perimeter of the for rotating disk 40; means for connecting 43 center post 41 to the rotating and sliding disk 40; means for connecting 44 optional side shield 40A to rotating and sliding disk 40; apertures 45 for mounting adjustable and removable back support 80; and apertures 46 for mounting adjustable and removable foot support 85.

Figure 6B:
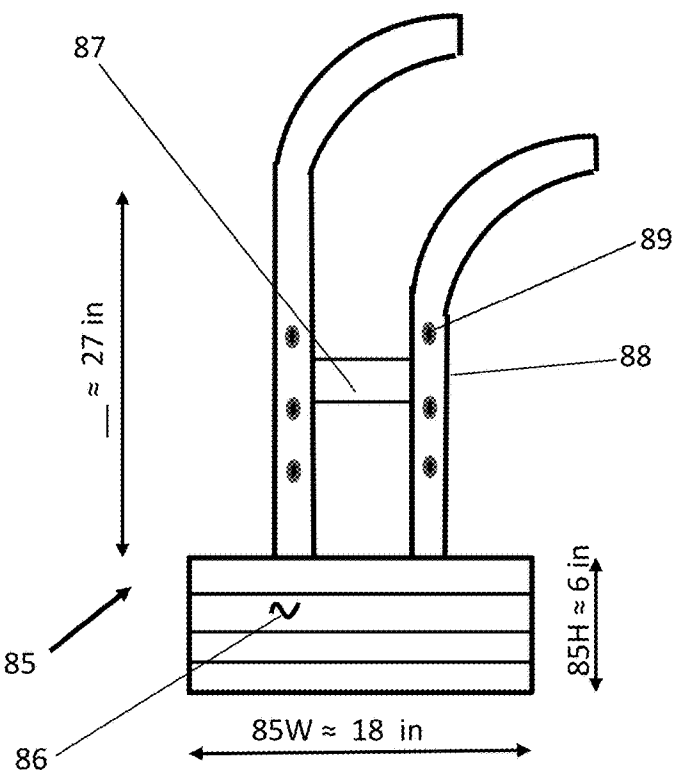
FIGS. 6A and 6B are sketches of the removable/adjustable back support and the removable/adjustable foot support of the Physical transfer electric assist device/board for people in therapy or in need of special care.
Figure 6A:
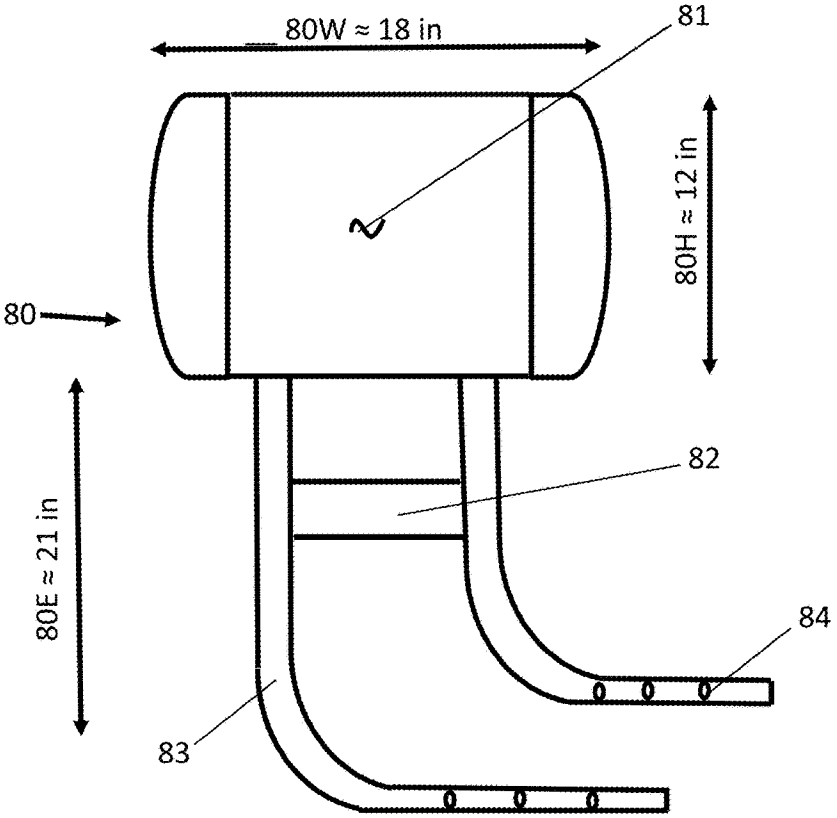
Figure 7A:
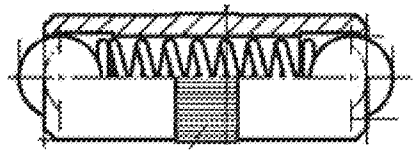
FIGS. 7A through 7F are sketches of various attachment means for the telescoping components of the Physical transfer electric assist device/board for people in therapy or in need of special care.
Figure 7B:
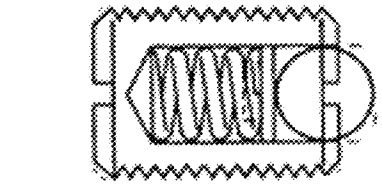
Figure 7C:
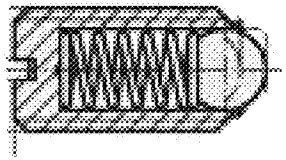
Figure 7D:
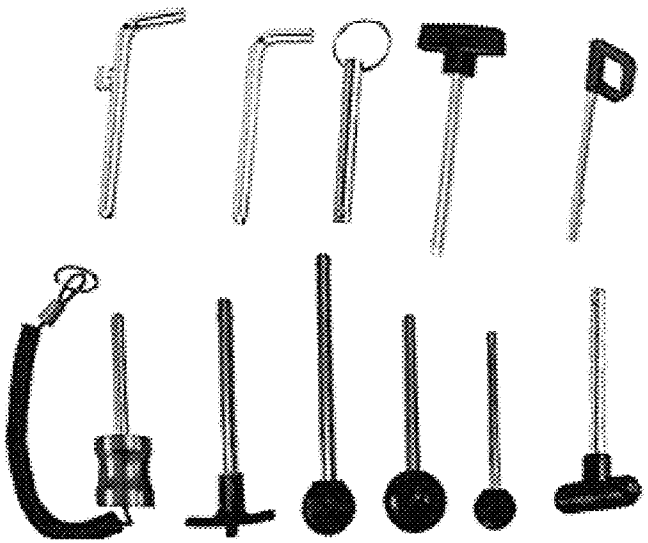
Figure 7E:
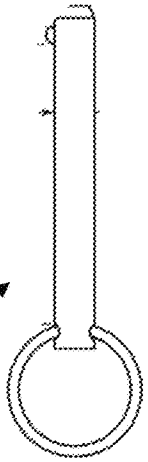
Figure 7F:
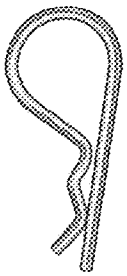
Figure 8A:
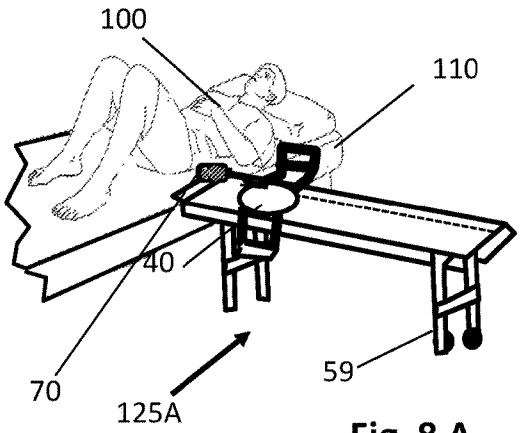
FIGS. 8A through 8D are sketches of the Physical transfer electric assist device/board in operation with a patient transferring to and from a hospital bed to a wheel chair.
Figure 8B:
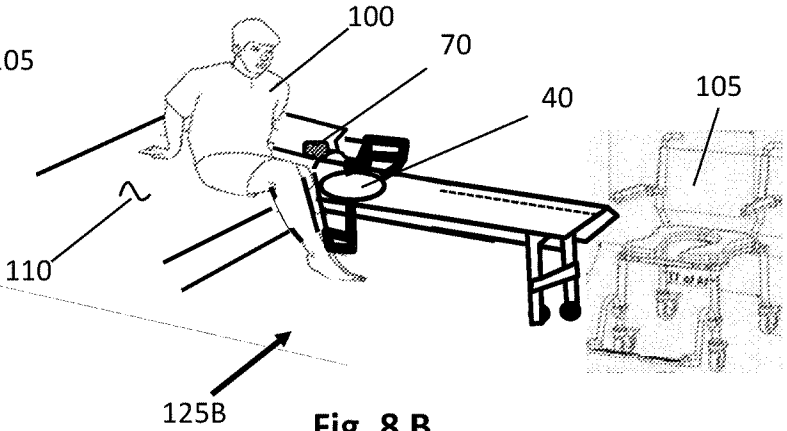
Figure 8C:
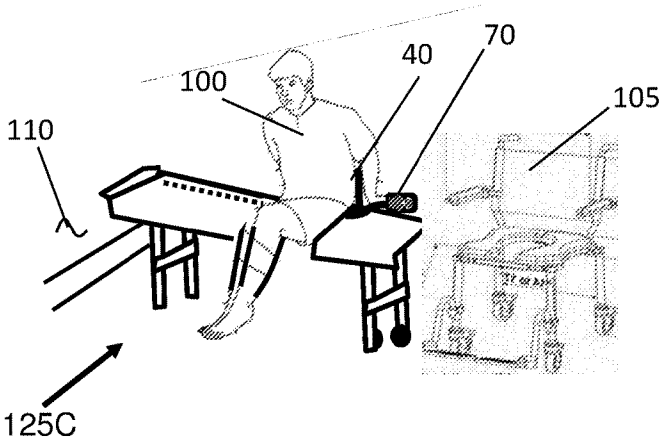
Figure 8D:
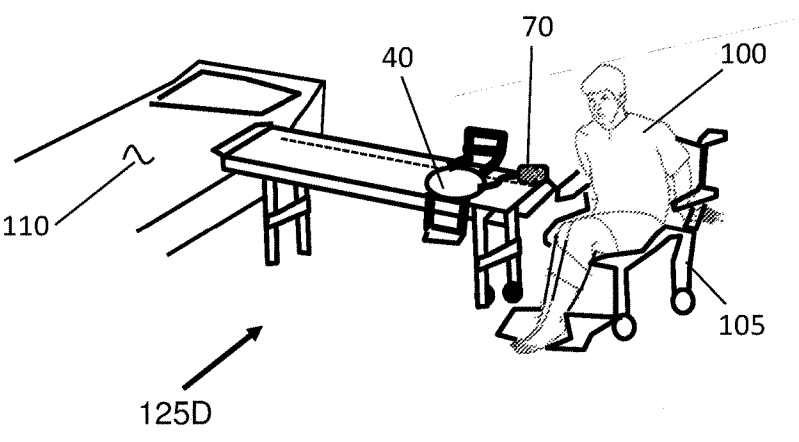

FIGS. 6A and 6B are sketches of the removable/adjustable back support 80 and the removable/adjustable foot support 85 of the physical transfer electric assist device/board 30 for people in therapy or in need of special care. Here are shown sketches that demonstrate: the adjustable and removable back support 80; width 80W (approximately 18 inches) of adjustable and removable back support 80; height 80H (approximately 12 inches) of adjustable and removable back support 80; extension 80E (approximately 21 inches) of adjustable and removable back support 80 from slidable disk 40; back plate or plane 81 of the adjustable and removable back support 80—durable material (plastic, metal, composite or the like) with or without padding; strut 82 to support and reinforce the tubular structure 83 of the adjustable and removable back support 80; tubular structure 83 of the adjustable and removable back support 80; the mounting apertures 84 in the tubular structure 83 of the adjustable and removable back support 80 used to removably connect with the rotating disk 40; the adjustable and removable foot support 85; width 85W (approximately 18 inches) of adjustable and removable foot support 85; height 85H (approximately 6 inches) of adjustable and removable foot support 85; extension 85E (approximately 27 inches) of adjustable and removable foot support 85 from slidable disk 40; foot plate or plane 87 of the adjustable and removable foot support 85—durable material (plastic, metal, composite or the like); strut 87 to support and reinforce the tubular structure 88 of the adjustable and removable foot support 85; the tubular structure 88 of the adjustable and removable foot support 85; and mounting apertures 89 in the tubular structure 88 of the adjustable and removable foot support 85 used to removably connect with the rotating disk 40.

FIGS. 7A through 7F are sketches of various attachment means for the telescoping components of the physical transfer electric assist device/board 30 for people in therapy or in need of special care. These are common fasteners used in a new and unique combination with the device 30. Here are shown: quick connect/disconnect fasteners 69 A through F such as quick spring detents, cotter clip, spring clips and the like as shown in drawings FIGS. 7A through 7F for removably fastening telescoping legs 53, 54 for front legs 52 and 60, 61 for rear legs 59 through apertures 58, 76; similarly used with adjustable back support 80 and foot support 85 in apertures 84, 89.

Figure 9A:
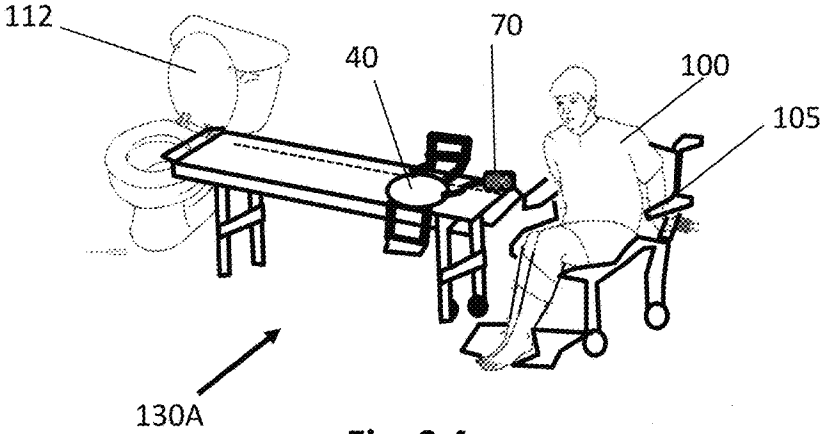
FIGS. 9A through 9C are sketches of the Physical transfer electric assist device/board in operation with a patient transferring to and from a wheel chair to a toilet or waste device.
Figure 9B:
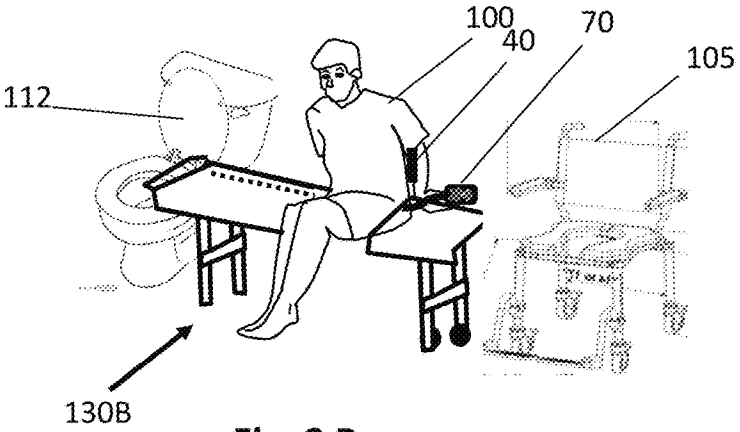
Figure 9C:
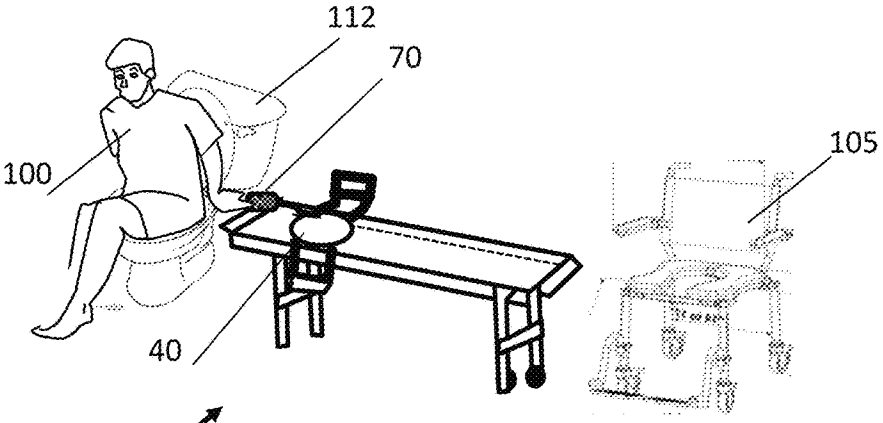
Figure 10B:
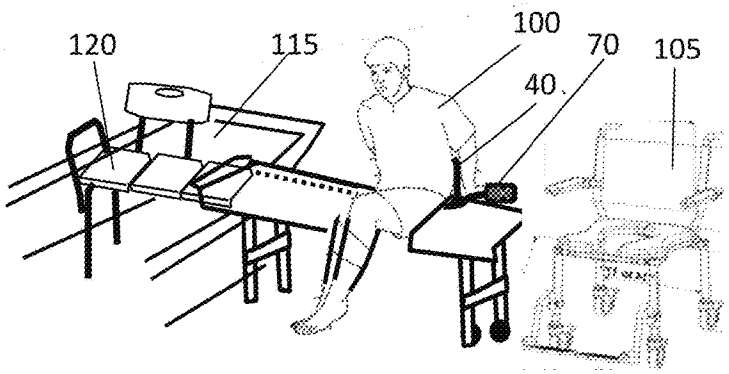
FIG. 10A through 10C are sketches of the Physical transfer electric assist device/board in operation with a patient transferring to and from a wheel chair to a tub or shower seat.
Figure 10A:
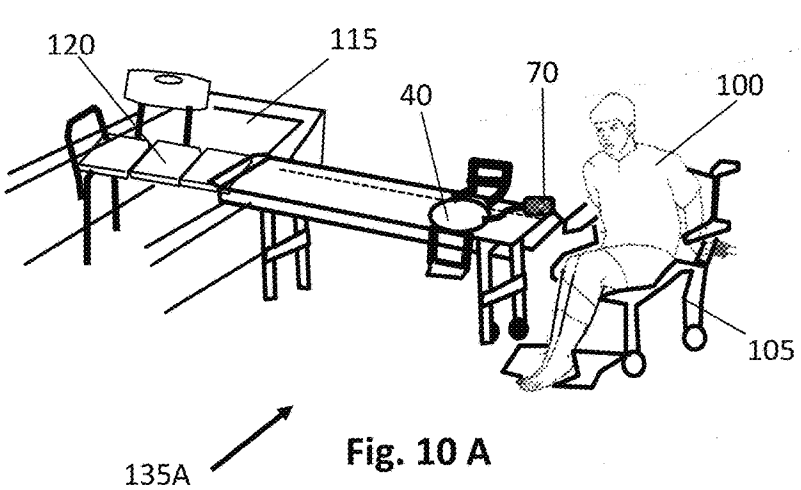
Figure 10C:
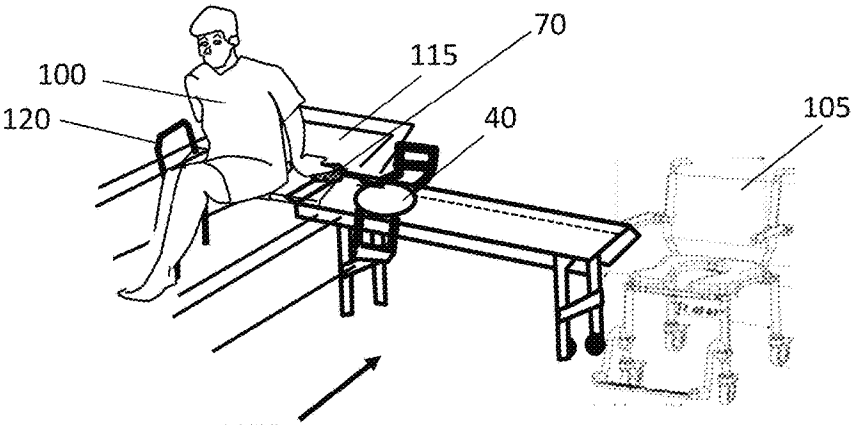

FIGS. 8A through 8D are sketches of the Physical transfer electric assist device/board in operation with a patient transferring to and from a hospital bed to a wheel chair. FIGS. 9A through 9C are sketches of the Physical transfer electric assist device/board in operation with a patient transferring to and from a wheel chair to a toilet or waste device. FIG. 10A through 10C are sketches of the Physical transfer electric assist device/board in operation with a patient transferring to and from a wheel chair to a tub or shower seat. These address the method of use and operation and are discussed in the below sections and paragraphs.

The details mentioned here are exemplary and not limiting. Other specific components and manners specific to describing the physical transfer device/board for people in therapy or in need of special care 30 may be added as a person having ordinary skill in the field of patient assist devices and their uses can well appreciate.

OPERATION OF THE PREFERRED EMBODIMENT

The physical transfer device/board for people in therapy or in need of special care 30 has been described in the above embodiment. The manner of how the device operates is described below. One notes well that the description above and the operation described here must be taken together to fully illustrate the concept of the physical transfer device/board for people in therapy or in need of special care 30. The preferred embodiment of a Physical transfer device/board for people in therapy or in need of special care is comprised of: (a) a top structure comprised of rotating and sliding disk with a tapered perimeter on its top surface and a center post connecting to a support plate; (b) the support plate further comprised of a center means for connecting the center post to the rotating and sliding disk and further comprised of roller or wheel mechanism/system to support, to provide a structural means for siding and rolling the support plate across the plank as the gear mechanisms are activated; (c) a top plank/board comprising an upper and lower surface and a disk path/groove; (d) a driving mechanism comprised of a power source connected to a motor with a rotating shaft, a means for transferring rotation force from the rotating shaft to a linear drive mechanism in the disk path/groove, a means for transferring rotation force to the seat disk, and a means for securing the driving mechanism to the bottom surface of the plank; and (e) a set of front legs and a set of rollable back legs, each set comprised of telescoping legs and supporting struts and each set with a securing means for hingeably/and a securing means for removably connecting front legs or rear legs to lower surface of plank/board wherein the device can assist a patient moving from one flat surface, Point A, to a second flat surface, Point B.

The physical transfer device/board for people in therapy or in need of special care 30 operates as follows: The device 30 is to be positioned as a bridge between point A and point B (point A: being a surface transferring from and point B: being a surface transferring to). The individual/patient 100 being transferred is positioned on one end of the device 30, sitting on top of the rotating/sliding disk 40. The disk 40 can then be rotated to a desired position, and then the individual/patient 100 to slide through to point B, and complete the process as stated in point A.

FIGS. 8A through 8D are sketches of the physical transfer electric assist device/board 30 in operation with a patient 100 transferring to and from a hospital bed 110 to a wheel chair 105. Shown here are the devices and items patient 100; wheelchair 105; overlap 35 for transfer board (approximately 3 inches); controller 70; seat 40; and hospital bed 110. The transfer steps are: a patient 100 transferring 125 A through D to and from a hospital bed 110 to a wheel chair 105.

FIGS. 9A through 9C are sketches of the physical transfer electric assist device/board 30 in operation with a patient 100 transferring to and from a wheel chair 105 to a toilet or waste device 112. Shown here are the devices and items patient 100; wheelchair 105; overlap 35 for transfer board (approximately 3 inches); toilet/waste device 112; controller 70; and seat 40. The transfer steps are: a patient 100 transferring 130 A through C to and from a toilet 112 to a wheel chair 105.

FIG. 10A through 10C are sketches of the physical transfer electric assist device/board 30 in operation with a patient 100 transferring to and from a wheel chair 105 to a tub or shower 115 seat/stool 120. Shown here are the devices and items patient 100; wheelchair 105; tub and shower 115; safety seat/stool 120; overlap 35 for transfer board (approximately 3 inches); controller 70; and seat 40. The transfer steps are: a patient 100 transferring 135 A through C to and from a stool 120 to a wheel chair 105.

Many uses are anticipated for the physical transfer device/board for people in therapy or in need of special care 30. Some examples, and not limitations, are shown in the following Table.

| ITEM | DESCRIPTION |
|---|---|
| 1 | mostly in health care |
| 2 | rehabilitation facilities |
| 3 | hospitals |
| 4 | old age residential areas |
| 5 | facilities for youth with disabilities |
| 6 | public places mandated for disabled accessibility |
| 7 | private homes/places |

With this description it is to be understood that the physical transfer device/board for people in therapy or in need of special care 30 is not to be limited to only the disclosed embodiment of product. The features of the physical transfer device/board for people in therapy or in need of special care 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. A Physical transfer device/board for people in therapy or in need of special care, the device is made of a durable and lightweight materials and comprised of: a) a top structure comprised of a rotating and sliding disk, the disk with a tapered perimeter on its top surface and with a center post connecting to a support plate; b) the support plate further comprised of a center means for connecting the center post to the rotating and sliding disk and further comprised of roller or wheel mechanism to support which provides a structural means for siding and rolling the support plate across a top plank/board as a gear mechanism is activated; c) the top plank/board further comprised of an upper and lower surface and a disk path/groove; d) a driving mechanism further comprised of a power source connected to a motor with a rotating shaft, a means for transferring rotation force from the rotating shaft to a linear drive mechanism in the disk path/groove, a connection means for transferring rotation force to the sliding disk, and a fastening means for securing the driving mechanism to the bottom surface of the plank; and e) a set of front legs and a set of rollable back legs, each set comprised of telescoping legs and supporting struts and each set with securing means for hingeably and removably connecting front legs or rear legs to lower surface of plank/board wherein the device can assist a patient moving from one flat surface, Point A, to a second flat surface, Point B.

2. The Physical transfer device/board according to claim 1 wherein the durable and lightweight materials is selected from the group consisting of an aluminum, a powder coated sheet metal, a reinforced plastic, a wood, a pressed fiber board, and a composite material.

3. The Physical transfer device/board according to claim 1 further comprising a side shield.

4. The Physical transfer device/board according to claim 1 wherein the top plank/board is further comprised of a second disk path/groove.

5. The Physical transfer device/board according to claim 1 further comprising an adjustable and removable back support.

6. The Physical transfer device/board according to claim 1 further comprising an adjustable and removable foot support.

7. The Physical transfer device/board according to claim 1 wherein the motor power is selected from the group consisting of electric alternating current, a direct current battery, a pneumatic, and a hydraulic power source.

8. The Physical transfer device/board according to claim 1 wherein the securing means for removably connecting front legs or rear legs to lower surface of plank/board is selected from the group consisting of spring detents, cotter clip, and spring clips.

9. The Physical transfer device/board according to claim 1 wherein the therapy or in need of special care is selected from the group consisting of a health care facility, a rehabilitation facility, a hospital, an old age residential area, a facility for youth with disabilities, a public place mandated for disabled accessibility, and a private home.

10. The Physical transfer device/board according to claim 1 wherein the center bearing/bushing is selected from a group consisting of a bushing, a ball bearing, a needle bearing, and a thrust bearings.

11. The Physical transfer device/board according to claim 1 wherein the drive mechanism is a worm gear.

12. A Physical transfer device/board for people in therapy or in need of special care, the device is made of a durable and lightweight powder coated aluminum and comprised of: a) a top structure comprised of a rotating and sliding disk, the disk with a tapered perimeter on its top surface and with a center post connecting to a support plate; b) the support plate further comprised of a ball bearing for connecting the center post to the rotating and sliding disk and further comprised of roller or wheel mechanism to support which provides a structural means for siding and rolling the support plate across a top plank/board as a gear mechanism is activated; c) the top plank/board further comprised of an upper and lower surface and a disk path/groove; d) a driving mechanism further comprised of a battery power source connected to a motor with a rotating shaft, a worm gear for transferring rotation force from the rotating shaft to a linear drive mechanism in the disk path/groove, a connection means for transferring rotation force to the sliding disk, and a fastening means for securing the driving mechanism to the bottom surface of the plank; and e) a set of front legs and a set of rollable back legs, each set comprised of telescoping legs and supporting struts and each set with securing means for hingeably and removably connecting front legs or rear legs to lower surface of plank/board wherein the device can assist a patient moving from one flat surface, Point A, to a second flat surface, Point B.

* * * * *